US005680466A

United States Patent [19]

Zelikovitz

[11] Patent Number: 5,680,466

[45] Date of Patent: Oct. 21, 1997

[54] OMNIDIRECTIONAL HEARING AID

[76] Inventor: Joseph Zelikovitz, P.O. Box 2499, Grove, Okla. 74344

[21] Appl. No.: 319,136

[22] Filed: Oct. 6, 1994

[51] Int. Cl.[6] ..... H04R 25/00

[52] U.S. Cl. ..... 381/68.1; 381/68; 381/25

[58] Field of Search ..... 381/25, 68, 68.1, 381/68.6, 72, 74, 26

[56] References Cited

U.S. PATENT DOCUMENTS

| | | | |
|---|---|---|---|
| 3,659,056 | 4/1972 | Morrison et al. . | |
| 3,894,196 | 7/1975 | Briskey . | |
| 3,983,336 | 9/1976 | Malek et al. . | |
| 4,060,696 | 11/1977 | Iwahara et al. . | |
| 4,531,229 | 7/1985 | Coulter | 381/68 |
| 4,633,498 | 12/1986 | Warnke | 381/25 |
| 4,712,244 | 12/1987 | Zwicker et al. | 381/68.1 |
| 4,731,850 | 3/1988 | Levitt et al. | 381/68.2 |
| 4,837,832 | 6/1989 | Fanshel | 381/68.4 |
| 4,879,749 | 11/1989 | Levitt et al. | 381/68.4 |
| 4,920,570 | 4/1990 | West et al. | 381/68 |
| 5,048,090 | 9/1991 | Geers | 381/68.6 |
| 5,202,927 | 4/1993 | Tøpholm | 381/68 |
| 5,303,306 | 4/1994 | Brillhart et al. | 381/68 |
| 5,325,436 | 6/1994 | Soli et al. | 381/68 |
| 5,434,924 | 7/1995 | Jampolsky | 381/23.1 |
| 5,479,522 | 12/1995 | Lindemann | 381/68 |

FOREIGN PATENT DOCUMENTS

| | | |
|---|---|---|
| 2135684 | 1/1973 | Germany . |
| 5541036 | 3/1980 | Japan . |

*Primary Examiner*—Minsun Oh

*Attorney, Agent, or Firm*—Sidley & Austin

[57] ABSTRACT

A hearing aid device is disclosed providing omnidirectional listening assistance for the hearing impaired individual. The person with the hearing impairment may have greater hearing sensitivity in one ear than the other. Sounds emanating on the opposite side of a person than the more sensitive ear may be lost because the more sensitive ear is not directionally situated to receive the sound most effectively. The invention is directed toward detecting sounds in the auditory field associated with the less sensitive ear and transmitting those detected sounds to the more sensitive ear for amplification therein. Where the dominant ear is also partially impaired, a second sound transducer may be added to detect the sound emanating in a second auditory range associated with the more sensitive, albeit partially impaired, ear. The detected signals from the first and second auditory ranges may be combined in this embodiment for amplification in the more sensitive ear. Thus, this invention provides for more efficient detection of sounds and a more effective sound delivery to the most sensitive ear. Effectively, both embodiments of this invention provide for sound detection in a three hundred and sixty degree (360°) range regardless of head movement or position.

18 Claims, 5 Drawing Sheets

OMNIDIRECTIONAL HEARING AID

TECHNICAL FIELD OF THE INVENTION

The present invention relates to a hearing aid system and, more particularly, to an omnidirectional hearing aid.

BACKGROUND OF THE INVENTION

The loss of hearing is a very large and growing problem for our society, particularly among the older segment of the population. Hearing aid devices are well-known in the art for enhancing an impaired person's hearing. Hearing aid devices operate by amplifying detected sound to a level the impaired individual can comprehend. Current hearing aid devices, however, do not effectively and efficiently detect and deliver sounds in a three hundred and sixty degree (360°) reception range. Further, current hearing aids do not deliver sounds to the most sensitive ear when the sounds emanate from an auditory field away from the hearing aid device.

Under normal circumstances, sound waves enter the outer ear and modify the shape of the tympanic membrane, commonly known as the ear drum. This change in shape of the tympanic membrane corresponds to pressure changes in the sound wave. The pressure on the tympanic membrane is applied directly to three ossicles located in the middle ear. The three ossicles, namely the malleus (the mallet), the incus (the anvil) and the stapes (the stirrup) vibrate in response to the pressure changes and ultimately apply pressure to the cochlea via the last of these ossicles, the stapes.

The stapes applies pressure to the oval window and transmits this pressure to the fluid-filled scala vestibuli, which lies on the opposite side of the oval window. The pressure waves which move through the perilymph in the scala vestibuli cause the movement of the basilar membrane. The basilar membrane selectively vibrates with the greatest amplitude at a particular point which is mechanically tuned to the frequency of the applied sound. The mechanical energy caused by the vibration of the membrane ultimately causes displacement of hair cells thereby transforming the mechanical motion into electrical stimuli. The depolarization of the hair cells stimulate the distal ends of corresponding nerve fibers thereby producing a perceived stimulus of sound by the listener.

In people with hearing impairments, one or more of the above activities is impaired thereby reducing the stimulus of the listener to a particular level of sound. Hearing aids amplify received sounds in the impaired person's ear to compensate for the impaired hearing activities.

In people with hearing impairments, the hearing may be totally lost in one ear. In this situation, the person with the hearing impairment may have a dominant ear where there is partial or total hearing capacity and a non-dominant ear where the hearing capacity is totally lost. In this situation, the dominant ear may be much more sensitive to the detection of sounds than the non-dominant ear.

That is, the hearing loss may be so severe in the deaf ear that a hearing aid will not be practical or effective for enhancing the loss of hearing. Placing the hearing aid in the dominant, or more sensitive, ear may also be ineffective in efficiently capturing sounds from the auditory field associated with the deaf side. This hearing aid placement is less effective because sound emanating from non-dominant side of the listener are most efficiently detected from the ear associated with that side of the person, not the opposite or dominant ear. It is often seen that a person afflicted with a total loss of hearing in the non-dominant ear often needs to turn his or her head and cup the ear of the dominant side to pick up the sounds coming from the side with the totally deaf ear, even though that person may wear a hearing aid. Such strained attempts at hearing are undesirable because they cause the listener to fatigue. The listener may also miss important and life-threatening sounds, such as car horns, trains, etc., just because the sounds emanate from the auditory field associated with the non-dominant ear. Thus, sole reliance on the dominant ear's reception of sound information directed at the non-dominant ear is undesirable.

Binaural hearing systems are known in the art such as U.S. Pat. No. 5,325,436 to Soli, et al.; U.S. Pat. No. 4,531,229 to Coulter; and, U.S. Pat. No. 3,894,194 to Briskey. The transmission of hearing aid information or control command over the airwaves is also well known, such as U.S. Pat. No. 5,303,306 to Brillhart, et al.; U.S. Pat. No. 5,202,927 to Topholm; and, U.S. Pat. No. 3,659,056 to Morrison, et al.

Hearing aid users with disproportionate hearing impairment between their ears continue to suffer from the lack of hearing detection and a loss of auditory information created by the absence of omnidirectional sound reception. This invention addresses needs of the hearing impaired condition where one ear is deaf or near deaf and the other ear has total or partial hearing capability.

SUMMARY OF THE INVENTION

The present invention is an assistive listening system for the hearing impaired that permits the listener to have omnidirectional degrees (360°) sound reception and delivery of sound to the most sensitive ear. The invention provides for omnidirectional listening assistance by detecting sounds from a first auditory field associated with a non-dominant ear and transmitting the detected sounds in the form of information sequels to a tuned receiver located in the dominant ear. The received signals are then reproduced and amplified in the dominant ear to simulate the detected sounds.

The dominant ear may not need independent assistance in detecting sounds from its second auditory field. As such, the construction of the hearing aid device in the dominant ear will minimize the obstruction of sound detection in the dominant ear. If the dominant ear requires independent enhancement of sounds emanating from a second auditory field, however, the device placed in the dominant ear may independently enhance the amplitude of the sounds detected in the auditory field of the dominant ear. This amplification will occur together with generating sound waves corresponding to the sounds detected from the sounds detected from the first auditory field associated with the non-dominant ear.

An aspect of this invention is to provide an assistive listening system that permits omnidirectional listening from a non-impaired ear. Another aspect of this invention is to provide an assistive listening system that permits omnidirectional listening from a partially impaired ear. Another aspect of this invention is to provide an assistive listening system having omnidirectional capability that is simple in construction and easily manufacturable.

BRIEF DESCRIPTION OF THE DRAWINGS

For a better understanding of the invention, reference is made to the following detailed description of representative embodiments taken in conjunction with the accompanying drawings, in which.

DETAILED DESCRIPTION

Figure 1:
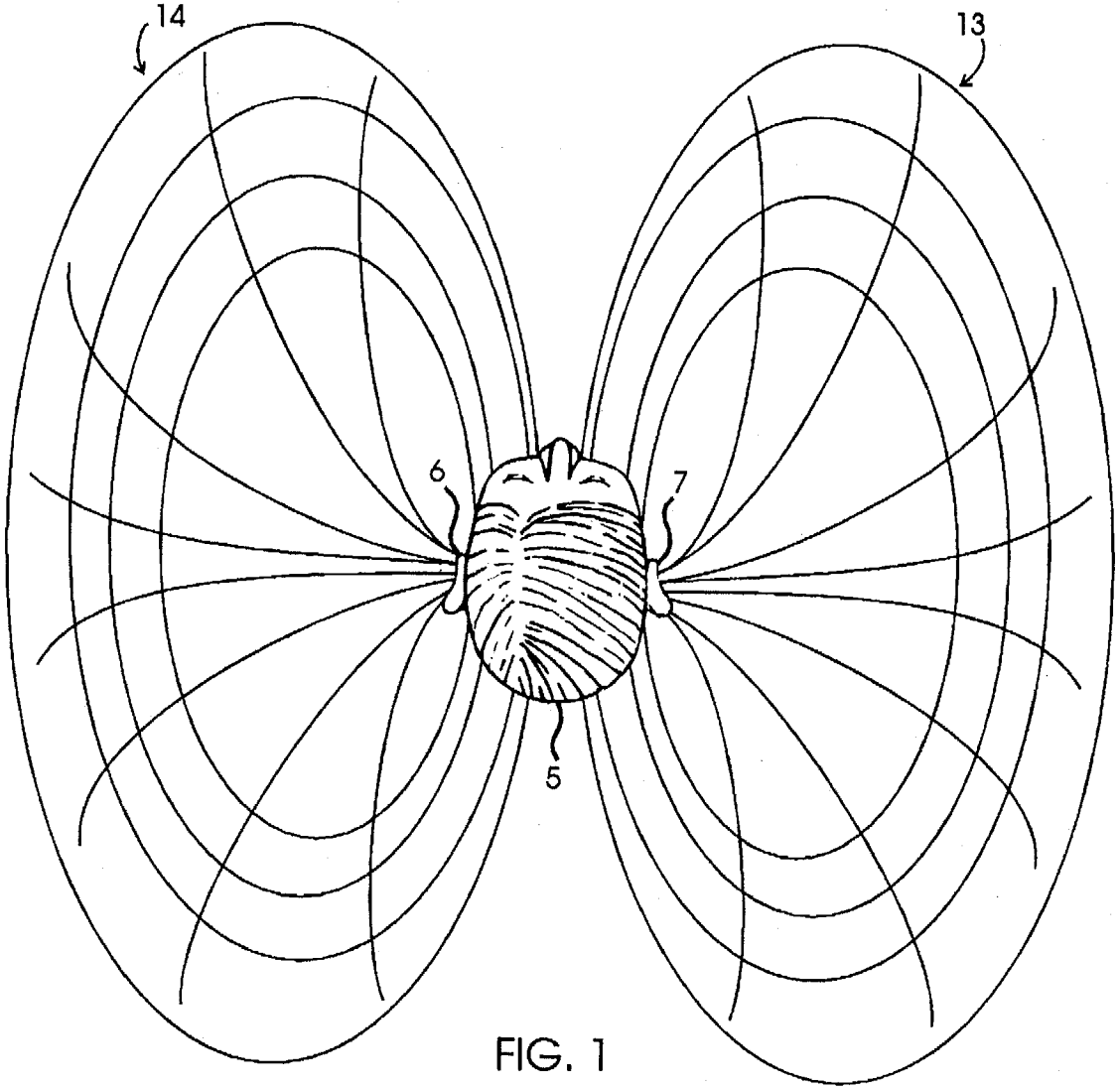
FIG. 1 is a top view of the auditory fields associated with the dominant and non-dominant ears.

FIG. 1 illustrates the primary auditory fields associated with each person. In FIG. 1, listener 5 has a first ear 7 with a first auditory field 13 and a second ear 6 with a second auditory field 14. For purposes of discussion, ear 7 will be designated as the non-dominant ear, or the ear that is less sensitive to sound. Further, ear 6 will be designated as the dominant ear, or the ear more sensitive to sound. The dominant and non-dominant ears are only selected as examples. The designation of the ears may be reversed depending on the circumstances at hand.

Auditory fields 13 and 14 show the directional attributes of sound for each ear of a listener. It can be seen that a first sound wave propagating toward a listener from the first auditory field 13 will be detected better by ear 7 than by ear 6 if ears 6 and 7 have no hearing impairment. Ear 7, however, may have less sensitivity to sound than ear 6. In fact, the hearing impairment in ear 7 may be so great as to make the use of a hearing aid in ear 7 impractical and ineffective.

Ear 6 will detect the sound wave emanating from the first auditory field 13, but the reception of this sound in ear 6 is hindered by the position of the ear in an opposite direction away from the origin of the sound. Thus, a sound wave originating from the first auditory field 13 will not be fully detected by dominant ear 6 because dominant ear 6 is not positioned directionally to fully detect this sound wave and a hearing aid placed in ear 7 may not compensate for the hearing impairment. Thus, in order to adequately detect sounds emanating from a first auditory field which corresponds to the auditory range of a non-dominant ear, the sounds should be detected on that non-dominant side and amplified in the dominant ear.

The dominant ear 6 may also be slightly impaired in its ability to detect sounds emanating from the second auditory field 14. In order to assist with the directional hearing on both sides of the listener, it may be preferable to amplify the sounds emanating from the second auditory field 14 corresponding to the auditory range of the dominant ear 6 as well as to amplify and transmit the sounds emanating from the first auditory field 13.

Figure 2:
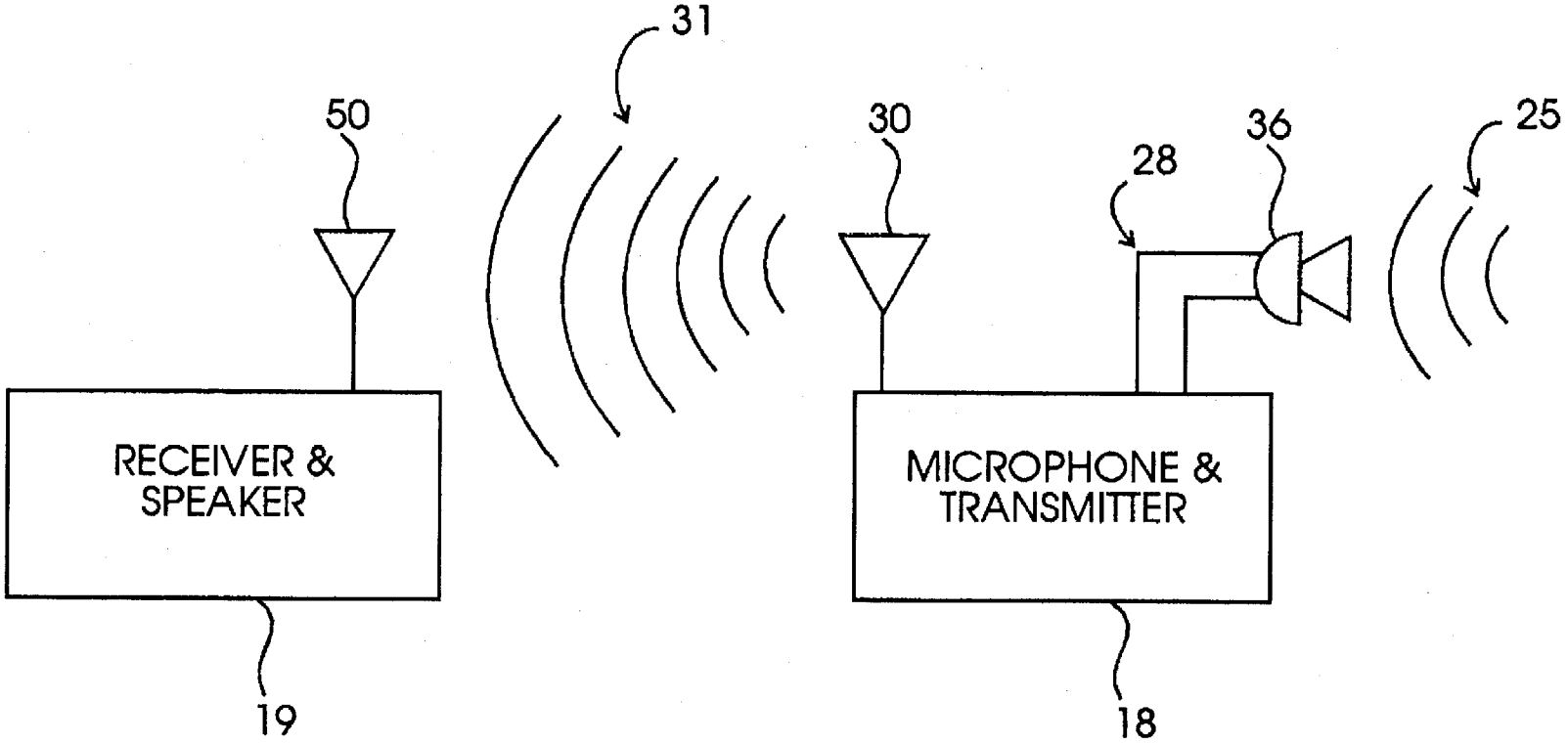
FIG. 2 is a block diagram of a first embodiment of the present invention.

FIG. 2 shows a block diagram of the present invention for listeners with disproportionate hearing levels. FIG. 2 discloses a block diagram for the major components in the present invention. Referring now to FIG. 2, a first unit 18 is shown having microphone and transmitter components. The first unit 18 is disposed in or associated with a first ear 7 having a first auditory field 13. The transducer 36 is capable of detecting sounds from this first auditory field 13. Sound waves 25 emanating from a first auditory field 13 are detected by the transducer 36. The transducer 36 is coupled to the remainder of the first unit 18 by lines 28. The sounds detected by the transducer 36 are converted into information signals which are transmitted to the second unit 19 by an FM transmitter in the first unit 18. The first unit 18 also has a transmitting antenna 30 for transmitting the information signals 31 to the second unit 19.

The second unit 19 is shown having receiver and speaker elements. The second unit 19 is associated with a second ear 6 having a second auditory field 14. The second unit 19 possesses a receiving antenna 50 capable of receiving transmitted information signals 31. Once received, the information signals are used to generate amplified sound waves corresponding to the detected sound waves 25.

The second unit 19 is disposed in or associated with the second ear to minimize the obstructions for the second ear 6 to detect sounds. That is, the second ear 6 should be able to hear sounds emanating from the second auditory field 14 even though the second unit 19 is disposed in or associated with the second ear 6.

In a second embodiment, if the second ear is also slightly impaired, the sound emanating from the second auditory field 14 may be detected using a transducer associated with the second unit 19 and the detected sounds will be amplified for the second ear. This is a second embodiment of the invention which compensates for hearing loss in both ears and allows for the dominate ear to hear sounds from a first auditory field associated with a non-dominant ear as well as sounds from the dominant side.

Figure 3:
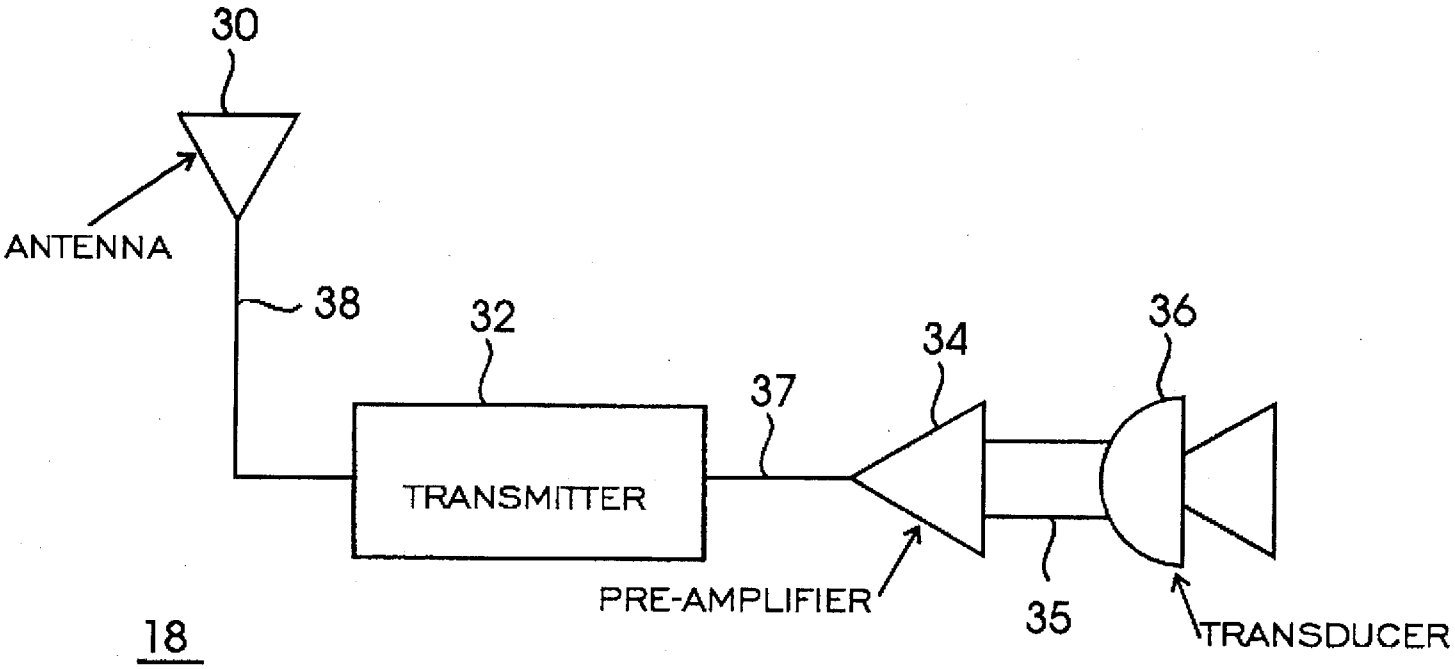
FIG. 3 is a circuit diagram of the first unit of FIG. 2.

First unit 18 is illustrated in greater detail in FIG. 3. In FIG. 3, a sound transducer 36, preferably a miniature directional microphone, receives sound from the first auditory field 13 and converts the sound into information signals representative of the detected sounds. The information signals from sound transducer 36 are coupled to a pre-amplifier 34 through lines 35. The signals are sent from the pre-amplifier 34 to transmitter 32 through line 37. Transmitter 32 modulates and transmits information signals representative of the detected sounds with transmitter antenna 30. Transmitter antenna 30 is coupled to the transmitter 32 through line 38. Preferably, transmitter 32 is a low-power FM transmitter with a range of one-half to two (½–2) feet.

Figure 4:
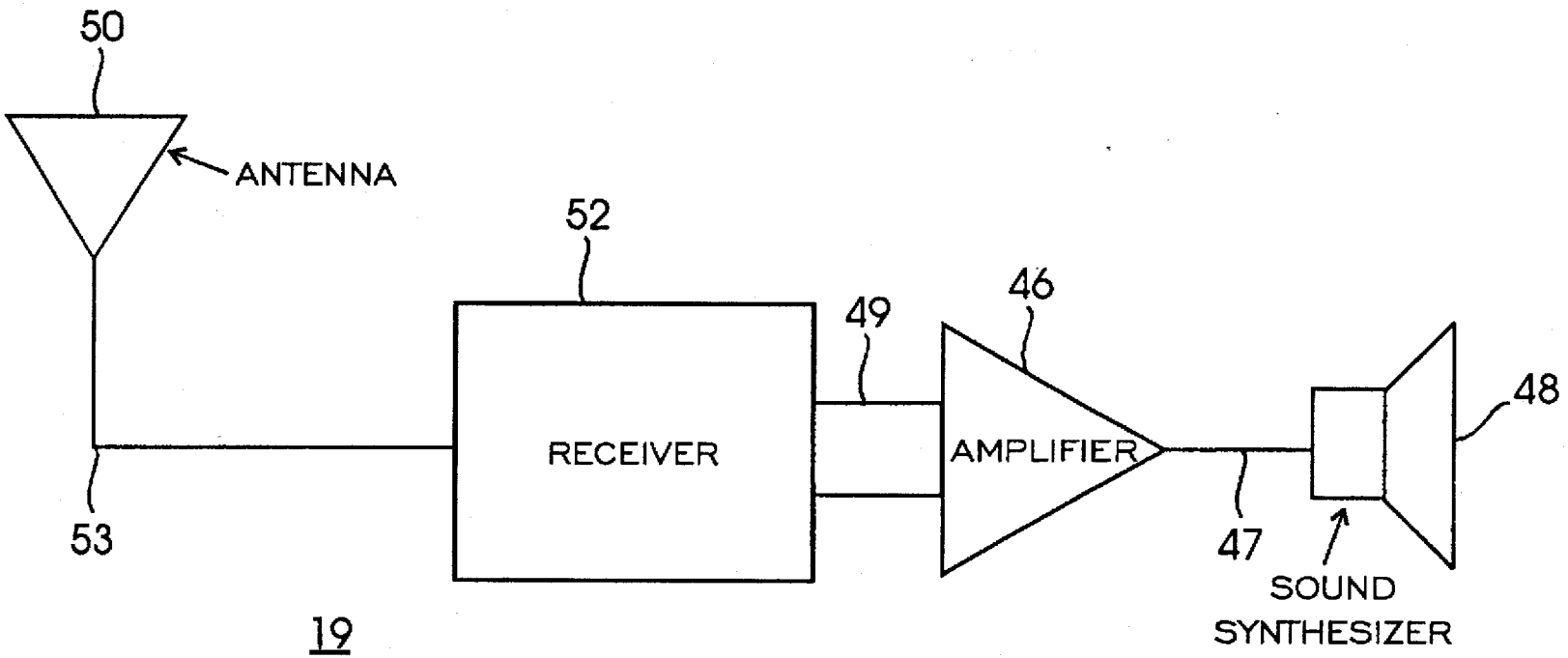
FIG. 4 is a circuit diagram of the second unit of FIG. 2.

The sound unit 19 is shown in FIG. 4. In FIG. 4, a receiver antenna 50 receives the transmitted information signals. The received information signals are coupled through line 53 to receiver 52. The receiver 52 is preferably a low-powered FM receiver tuned to the same frequency as that of the transmitter 32. The receiver 52 demodulates the information signals for coupling to an amplifier 46 through lines 49. The received signal is then fed to sound synthesizer 48 through line 47. Sound synthesizer 48 is preferably a miniature speaker.

Thus, sounds directed to the non-dominant ear can be detected and transferred to the more sensitive dominant ear for improved hearing of all sounds emanating from first and second auditory fields. When the sound reception of the first auditory field and the second auditory field are combined, the resulting auditory range of reception encompasses approximately three hundred and sixty degrees (360°). This is shown in FIG. 1 where the range of hearing may be measured two ways. First, there is an approximate three hundred and sixty degree (360°) range of hearing which surrounds the listener as measured from the center of the listener's head after the first auditory field 13 is combined with the second auditory field 14. This combined range of hearing may encompass at least three hundred and thirty degrees (330°) as measured from the center of the listener's head. Thus, this first measurement of a range of hearing is approximately three hundred and sixty degrees (360°).

Second, each auditory range for each ear may be independently measured and combined. That is, the auditory range for one ear may independently encompass approximately two hundred and thirty degrees (230°) as measured from that ear's perspective. Using this measurement, there may be a combined total range of four hundred and sixty degrees (460°) of coverage. Thus, the range of hearing as measured from the combined perspective of each ear would be three hundred and sixty degrees (360°) with a one hundred degree (100°) overlap.

Thus, there is at least approximately three hundred and sixty degrees (360°) of combined hearing range using the present invention under either method of measurement. It is important to note that this approximate three hundred and sixty degree (360°) range of hearing remains constant even though the head turns and moves. Stationery transmitters of the prior art placed on the front of clothing cannot accommodate this approximate and constant three hundred and sixty degree (360°) range without being affected substantially by the movement of the head or the body.

Figure 5:
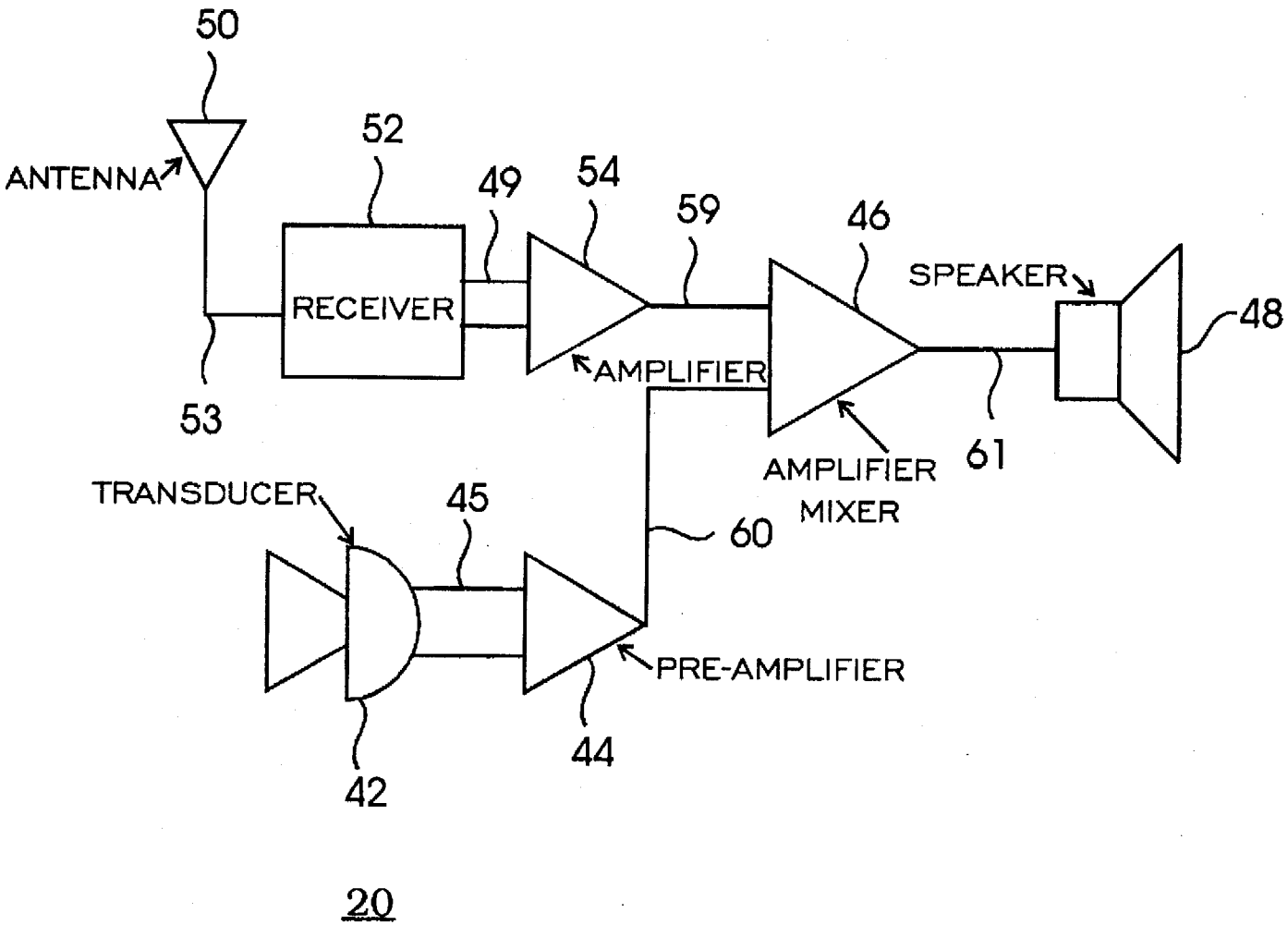
FIG. 5 is a circuit diagram of a second embodiment of the present invention.

A second embodiment of the present invention is shown in FIG. 5. This embodiment is useful when the dominant ear also has partial hearing impairment, but it is still more sensitive to sound than the non-dominant ear. In FIG. 5, a second sound transducer 42 is combined with the receiver and speaker elements described in FIG. 4. The transducer will detect the sounds emanating from the second auditory field 14, for amplification and combination with the sounds detected and transmitted from the first auditory field 1 through the receiver 52. Preferably a miniature directional microphone receives sound from a second auditory field and converts the sound into a second information signal. The information signal from transducer 42 is coupled to a pre-amplifier 44 through lines 45. The signals from pre-amplifier 44 are then fed to an input of amplifier/mixer 46 through line 60. The amplifier/mixer 46 then amplifies and mixes the signals received from the amplifier 46 through line 60 with the received information signal coupled from amplifier 54 through line 59. The signals are combined in amplifier/mixer 46 and coupled through line 61 to speaker 48 for reproduction of the sounds in the dominant ear 6.

As with the other embodiment, the sounds detected in the first auditory field are detected by the first unit 18, converted into information signals, and transmitted to the second unit 20. The antenna 50 receives the information signals which are coupled to receiver 52 by line 5. The receiver 52 converts the information signals to analog signals and couples the information signals to pre-amplifier 54 by lines 49. The sounds from the non-dominant side are mixed and amplified with the sounds detected and amplified on the dominant side in mixer/amplifier 46. Thus, detected sounds from the dominant and non-dominant side are detected more efficiently by transducers directed to the applicable auditory field and these detected sounds are amplified in the more sensitive, or dominant, ear of the listener.

One may also use an amplifier with a balance control for adjusting the volume of sounds detected from the dominant and non-dominant listening fields. In addition, the application of digital sound processing techniques can be utilized to enhance the quality of the sounds generated by the hearing aid device. The enhancement devices can be digital or analog and may use analog-to-digital converters controlled by a software implemented program.

Thus, there has been shown and described a novel omnidirectional assistive listening system for people with hearing impairments. It is to be recognized and understood, however, that various changes, modifications and substitutions in the form and of the details of the present invention may be made by those skilled in the art without departing from the scope of the following claims.

We claim:

1. An omnidirectional assistive listening system, comprising:

a first directional transducer associated with a first ear having a first auditory field, said first directional transducer capable of detecting sounds from said first auditory field;

a transmitter coupled to said first directional transducer capable of transmitting information signals corresponding to said detected sounds from said first auditory field;

a second directional transducer associated with a second ear having a second auditory field, said second directional transducer is capable of detecting sounds from said second auditory field;

a receiver coupled to said second directional transducer;

a receiver antenna coupled to said receiver capable of receiving transmitted information signals corresponding to said detected sounds from said first auditory field; and, a speaker coupled to said receiver and said second directional transducer, said speaker is capable of generating amplified sound waves corresponding to a combination of the sound waves detected by said first and said second transducers, wherein combining the sound reception from said first auditory field and said second auditory field results in a sound reception range of at least approximately three hundred and sixty degrees (360°).

2. The assistive listening system of claim 1 further comprising a transmitting antenna coupled to said transmitter.

3. The assistive listening system of claim 1, wherein said first directional transducer is a miniature directional microphone.

4. The assistive listening system of claim 1, wherein said second directional transducer is a miniature directional microphone.

5. The assistive listening system of claim 1, wherein said transmitter is a low-power FM transmitter with a range of one to two feet.

6. The assistive listening system of claim 1, wherein said receiver is a low-power FM receiver.

7. An omnidirectional assistive listening system, comprising:

a directional transducer associated with a first ear having a first auditory field, said directional transducer is capable of detecting sounds from said first auditory field;

a transmitter coupled to said directional transducer capable of transmitting information signals corresponding to said detected sounds from said first auditory field;

a receiver coupled to a receiver antenna associated with a second ear having a second auditory field and capable of receiving transmitted information signals corresponding to said detected sounds from said first auditory field; and, a speaker coupled to said receiver, said speaker capable of generating amplified sound waves corresponding to a combination of the sound waves transmitted to said receiver from said transmitter as said information signals corresponding to said detected sounds from said first auditory field and the actual sound reception of said second ear having said second auditory field, wherein combining the sound reception from said first auditory field and said second auditory field results in a sound reception range of at least approximately three hundred and sixty degrees (360°).

8. The assistive listening system of claim 7 further comprising a transmitting antenna coupled to said transmitter.

9. The assistive listening system of claim 7, wherein said first directional transducer is a miniature directional microphone.

10. The assistive listening system of claim 7, wherein said transmitter is a low-power FM transmitter with a range of one to two feet.

11. The assistive listening system of claim 7, wherein said receiver is a low-power FM receiver.

12. A method of onmidirectionally assisting hearing, comprising the steps of:

detecting sounds from a first auditory field associated with a first ear by using a first directional transducer capable of detecting sounds from said first auditory field;

transmitting information signals corresponding to said detected sounds from said first auditory field by using a transmitter wherein said transmitter is coupled to said directional transducer;

receiving the transmitted information signals corresponding to said detected sounds from said first auditory field by using a receiver wherein said receiver is coupled to a receiver antenna associated with a second ear having a second auditory field; and amplifying sound waves corresponding to the received signal as said information signals corresponding to said detected sounds from said first auditory field using a speaker associated with said second ear and for combining with the actual sound reception of said second ear having said second auditory field, wherein the combination of the sound reception from said first auditory field and said second auditory field results in a sound reception range of approximately three hundred and sixty degrees (360°).

13. The assistive listening system of claim 12, wherein said first directional transducer is a miniature directional microphone.

14. The assistive listening system of claim 12, wherein said transmitter is a low-power FM transmitter with a range of one to two feet and said receiver is a low-power FM receiver.

15. The method of omnidirectionally assisting hearing of claim 12, further comprising the steps of:

detecting sounds from said second auditory field associated with said second ear;

supplementing the sound reception in said second auditory field by amplifying the detected sounds from said second auditory field and combining the amplified sounds with said amplified sounds from said first auditory field.

16. The assistive listening system of claim 15 wherein the step of detecting sounds from said second auditory field is accomplished using a second directional transducer.

17. The assistive listening system of claim 16, wherein said first and second directional transducers are miniature directional microphones.

18. The assistive listening system of claim 15, wherein said transmitter is a low-power FM transmitter with a range of one to two feet and said receiver is a low-power FM receiver.

* * * * *